US005259772A

United States Patent [19]

Fusselman et al.

[11] Patent Number: 5,259,772

[45] Date of Patent: Nov. 9, 1993

[54] CONNECTORS WITH GROUND STRUCTURE

[75] Inventors: David F. Fusselman, Middletown; Peter K. Townsend, Camp Hill, both of Pa.

[73] Assignee: E. I. Du Pont de Nemours and Company, Wilmington, Del.

[21] Appl. No.: 766,698

[22] Filed: Sep. 27, 1991

Related U.S. Application Data

[62] Division of Ser. No. 536,855, Jun. 8, 1990, abandoned.

[51] Int. Cl.[5] ..... H01R 4/66

[52] U.S. Cl. ..... 439/108; 439/607

[58] Field of Search ..... 439/81, 80, 607-610, 439/79, 108, 95

[56] References Cited

U.S. PATENT DOCUMENTS

| | | | |
|---|---|---|---|
| 4,451,107 | 5/1984 | Dola et al. | 339/143 |
| 4,568,134 | 2/1986 | DeMondi | 339/17 |
| 4,601,527 | 7/1986 | Lemke | 439/108 |
| 4,655,518 | 4/1987 | Johnson et al. | 339/17 |
| 4,686,607 | 8/1987 | Johnson | 361/413 |
| 4,806,107 | 2/1989 | Arnold et al. | 439/79 |
| 4,824,383 | 4/1989 | Lemke | 439/108 |
| 4,836,791 | 6/1989 | Grabbe et al. | 439/79 |
| 4,840,573 | 6/1989 | Seidel et al. | 439/92 |
| 4,846,727 | 7/1989 | Glover et al. | 439/608 |
| 4,867,690 | 9/1989 | Thumma | 439/79 |
| 4,869,677 | 9/1989 | Johnson et al. | 439/80 |
| 4,898,546 | 2/1990 | Elco et al. | 439/608 |
| 4,952,172 | 8/1990 | Barkus et al. | 439/532 |
| 4,959,024 | 9/1990 | Czeschka | 439/607 |
| 4,959,626 | 9/1990 | Mouissie | 439/607 |

FOREIGN PATENT DOCUMENTS

| | | | |
|---|---|---|---|
| 0365179 | 4/1990 | European Pat. Off. | 13/658 |
| 3904461 | 9/1990 | Fed. Rep. of Germany | 13/658 |

*Primary Examiner*—Larry I. Schwartz
*Assistant Examiner*—Hien D. Vu

[57] ABSTRACT

The present invention relates to electrical connectors with a ground structure for impedance and cross talk control between signal carrying conductors.

2 Claims, 4 Drawing Sheets

CONNECTORS WITH GROUND STRUCTURE

CROSS REFERENCE TO RELATED APPLICATION

This is a divisional application of copending U.S. patent application Ser. No. 07/536,855 filed Jun. 8, 1990 now abandoned.

BACKGROUND OF THE INVENTION

1. Field of the Invention.

This invention relates to electrical connectors with a ground structure for impedance and cross talk control between signal carrying conductors.

2. Description of Related Art.

With the advance of technology, a high density of electronic circuits and components can be located on a printed wiring board or printed circuit board (PCB). Along with this miniaturization of electronic circuits and components, electrical connectors are needed to electrically and mechanically interconnect one PCB, such as a back panel or mother board, to one or more other PCBs, such as daughter boards. Further, it is typically desirable for such connectors to have a high signal density capacity. That is, the connectors should permit a high number of signals to pass through the connector per unit volume of the connector. However, electrical signals carried on a conductor can interfere with a signal carried on an adjacent conductor.

This interfering electrical effect that an electrical signal carried on a given conductor exerts on a signal carried on an adjacent conductor is referred to as "cross talk." Controlling this cross talk is especially important in high density connectors. Such control can be implemented in a variety of ways.

One method of controlling cross talk is to connect certain terminals in a high density connector to conductive areas of a printed circuit board that are in turn grounded or connected to a predetermined ground potential. This solution is external to the connector.

U.S. Pat. Nos. 4,655,518 (to Lennart B. Johnson et al.). 4,686,607 (to Lennart B. Johnson) and 4,869,677 (to Lennart B. Johnson et al.) disclose a daughter board-/backplane assembly with contact elements dedicated for grounding purposes. Header contact elements have contacts that can be connected to ground or a predetermined potential on a backplane. The header contact elements have other spring contacts carried by an inside header wall for touching contacts carried by a right angle receptacle outer wall. Other contacts are integral with and perpendicular to the contacts carried by the right angle receptacle outer wall for connection to the daughter board.

U.S. Pat. No. 4,601,527 issued to Timothy A. Lemke discloses an internal shielding structure for connectors, specifically in vertical and right angle headers. The shielding structure includes a ground strip affixed to a mating surface of a header housing. The shielding structure further includes an elongated conductive spring contact with contact beams that extend in holes of side walls of the housing, lock tabs that connect to the ground strip and ground bars for connection to a grounded chassis.

U.S. Pat. No. 4,824,383 issued to Timothy A. Lemke discloses a shielding structure in connectors or plug-type terminators for either a multiple conductor cable or a multiple tracing substrate that electrically isolates individual or groups of contact elements in the terminator to prevent or minimize cross talk between adjacent conductors and to prevent or minimize degradation of signal transmission. The terminator includes a ground structure with generally U-shaped channels. Contact elements extend into the channels. The ground structure is connected to a predetermined potential, rather than dedicating some of the contact elements for this purpose.

U S. Pat. No. 4,898,546 issued to Richard A. Elco et al. discloses a ground shield device for right angle connectors. A different one of the shield devices straddles alternate columns of contact elements in the connector. Each shield device clips to a tail of one of the contact elements straddled by the shield device. The shield devices are connected to ground or a predetermined potential.

It is an object of this invention to provide high density electrical connectors for electrically and mechanically interconnecting electronic circuits and/or components controlling impedance and/or cross talk within the connectors.

Furthermore, it is an object of this invention to provide high density electrical connectors for electrically and mechanically interconnecting a circuit assembly and a plurality of terminals arranged in rows and columns in a mating connector to control impedance and-/or cross talk thereby to reduce, prevent or minimize degradation of signal transmission within the receptacles.

SUMMARY OF THE INVENTION

The present invention is directed to an electrical connector for electrically and mechanically interconnecting a circuit assembly having a plurality of contact regions and a mating connector having first side walls, a plurality of first contacts arranged in rows and columns within the first side walls and at least one second side contact, the electrical connector comprising:

a first plurality of electrically conductive pins, each of the pins having a first end and a second end, the first ends for engaging the first contacts;

an insulative housing having a cavity open at a first end end, enclosed by front and rear elongated side walls and two end walls together with a floor perforated with a plurality of through holes each engaging one of the pins, a side skirt extending downward from each front and rear side wall, with a plurality of grooves, each of the grooves extending parallel to the pins and separated by a rib in each side skirt;

an elongated ground strip mounted between the side skirts, the ground strip having a plurality of notches aligned with an end of each of the grooves in the side skirts;

an electrically conductive spring contact formed to have contact beams for engaging the second contacts and projecting upward in a common plane from a carrier strip, a plurality of locking tabs attached to the carrier strip and projecting away from each of the beams, a plurality of shelf tabs attached to the carrier strip between the locking tabs and extending in the same direction as the locking tabs;

the spring contact mounted in the housing so that each of the beams is in contact with an interior side of the front and rear side wall, and the shelf tabs and locking tabs bent to grip flat sides of the ground strip; and a second plurality of pins having first ends and second ends, the first ends of the second plurality of pins connected to the carrier strip such that second ends of the first plurality of pins and the second ends of the second plurality of pins are arranged in rows and columns to engage the contact regions.

BRIEF DESCRIPTION OF THE DRAWINGS

The invention can be more fully understood from the following detailed description thereof in connection with accompanying drawings which form a part of this application and in which.

DESCRIPTION OF THE PREFERRED EMBODIMENT(S)

Figure 1:
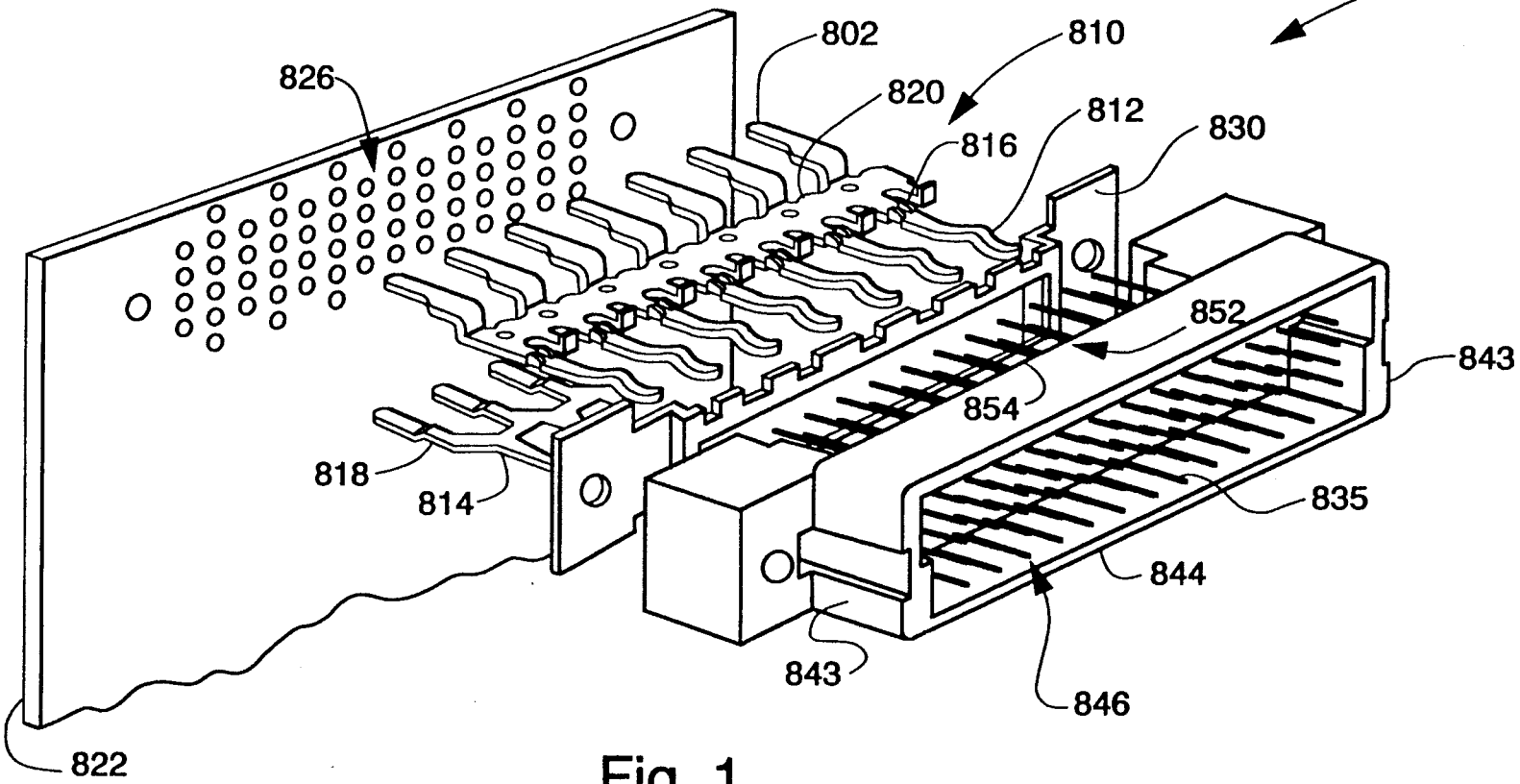
FIG. 1 is an exploded perspective view of a high density connector assembly in accordance with the present invention, the assembly including a high density vertical connector for interconnecting a circuit assembly and a mating connector.

Throughout the following detailed description, similar reference characters refer to similar elements in all figures of the drawings.

Figure 2:
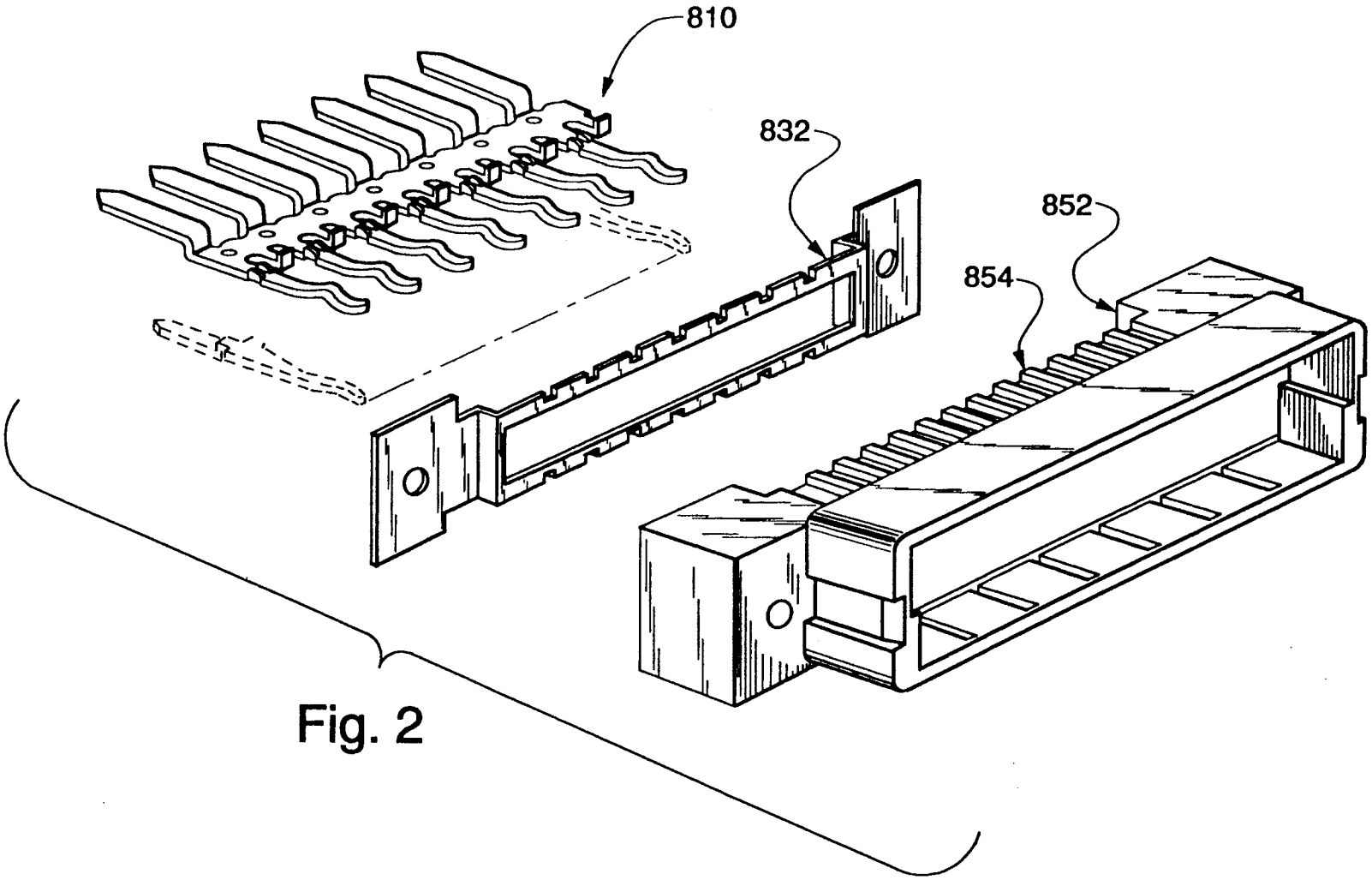
FIG. 2 is an exploded perspective view of parts of the high density vertical connector of FIG. 1.

Referring to FIG. 1, there is illustrated an exploded perspective view of a high density connector assembly in accordance with the present invention. The assembly includes a high density vertical connector or header 800 for interconnecting a circuit assembly 822 and a mating connector (not depicted). FIG. 2 is an exploded perspective view of parts of the high density vertical header 800 of FIG. 1. The connector 800 comprises a high density vertical header 800 for interconnecting the circuit assembly 822 having a plurality of contact areas 826 and a mating connector including a plurality of terminals with a plurality of first contacts arranged in rows and columns in a housing, the mating connector further including at least one second side contact. Suitable connectors that can be used for mating with the connector 800 of the present invention are disclosed in U.S. patent application Ser. No. 07/536,855 filed Jun. 8, 1990, now abandoned which is hereby incorporated by reference. The header 800 is similar to the header assembly disclosed in U.S. Pat. No. 4,601,527 which is hereby incorporated by reference. However, pins 802 (which are not disclosed in U.S. Pat. No. 4,601,527) have been connected to elongated conductive metal spring contacts 810 (which are identical to spring contacts disclosed in U.S. Pat. No. 4,601,527). The pins 802 are for connecting to the conductive regions 826, such as plated through holes 826, on or in the circuit assembly 822.

Figure 3:
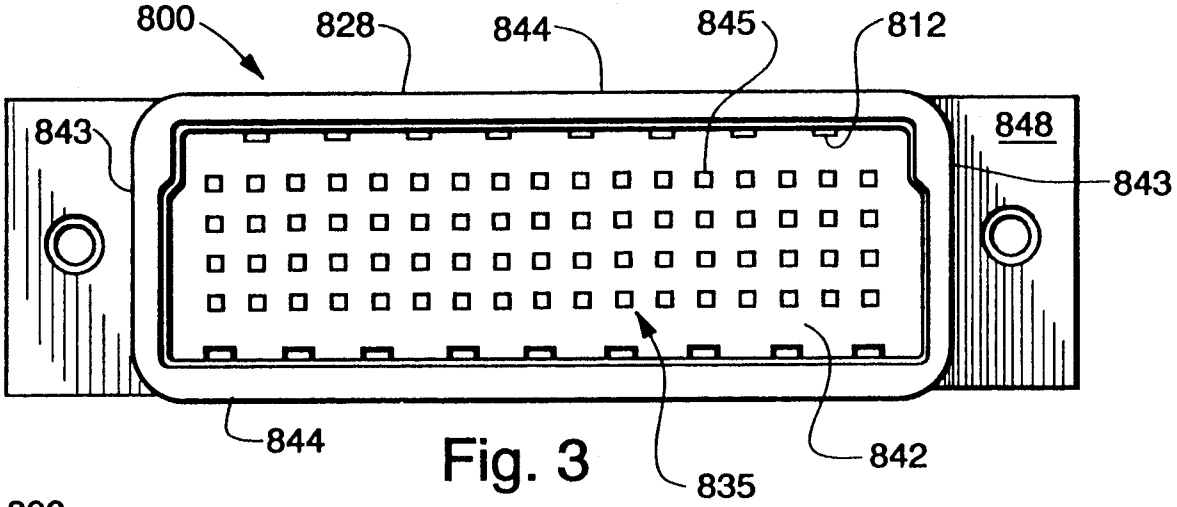
FIG. 3 is an enlarged view of a top or first mating side of the high density vertical connector of FIG. 1.
Figure 6:
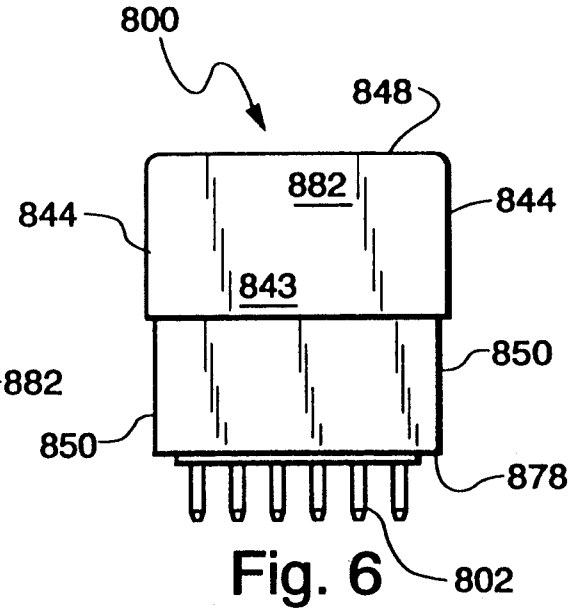
FIG. 6 is an enlarged view of an end of the vertical connector of FIG. 1.
Figure 5:
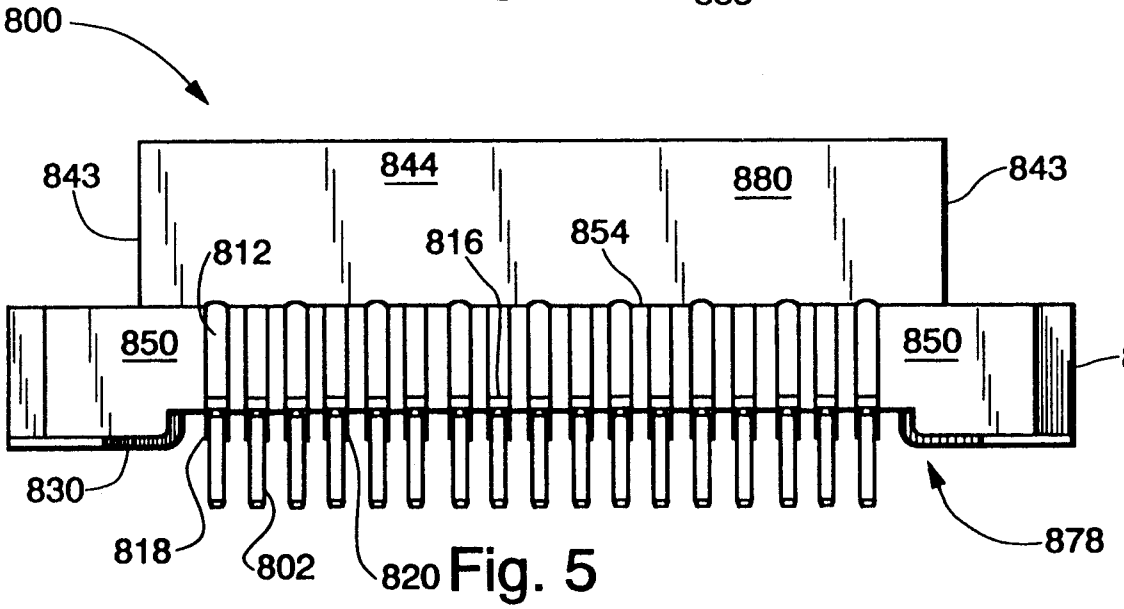
FIG. 5 is an enlarged view of a front side of the vertical connector of FIG. 1.
Figure 4:
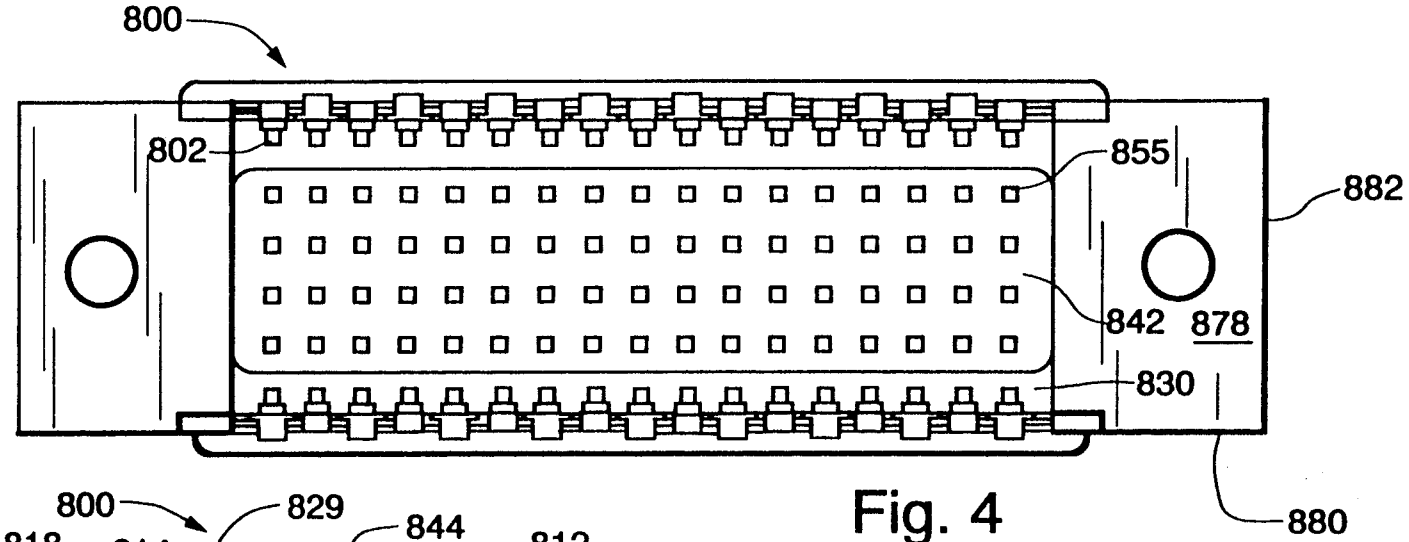
FIG. 4 is an enlarged view of a bottom or second mating side of the vertical connector of FIG. 1.
Figure 7:
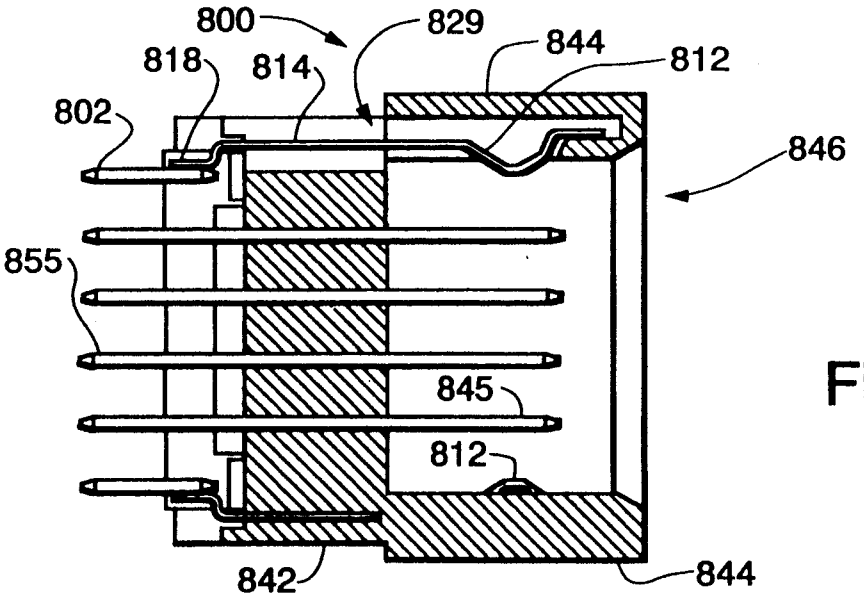
FIG. 7 is a sectional view of the vertical connector of FIGS. 1-6.

FIG. 3 is an enlarged view of a top or first mating side 848 of the high density vertical header 800 of FIG. 1. FIG. 4 is an enlarged view of a bottom or second mating side 878 of the vertical header 800 of FIG. 1. FIG. 5 is an enlarged view of a front side 880 of the vertical header 800 of FIG. 1. FIG. 6 is an enlarged view of an end 882 of the vertical header 800 of FIG. 1. FIG. 7 is a cross sectional view of the header 800.

The header 800 comprises a plurality of electrically conductive pins 835; an insulative housing 828; an elongated ground strip 830; at least one elongated conductive spring contact 810; and a second plurality of pins 802.

Referring, for instance, to FIG. 7, each one of the first plurality of electrically conductive contact elements or pins 835 has a first contact or end 845 and a second contact or end 855. The first ends 845 are for engaging the contacts of a mating connector.

The insulative housing 828 has a cavity or contact region 846 open at a first end. The cavity 846 is partially enclosed by front and rear elongated side walls 844 and two end walls 843 together with a base or floor 842. The floor 842 is perforated with a plurality of through holes. Each one of the through holes (or the cylindrical walls in the floor 842 defining the through holes) engages one of the pins 835. A side skirt 850 extends downward from each front and rear side wall 844. A plurality of grooves 852 extend parallel to the pins 835 in exterior surfaces of the skirt 850. The grooves 852 are separated by a rib 854 in the side skirts 850.

The elongated ground strip 830 is mounted on a second end of the housing 828 between the side skirts 850. The ground strip 830 has a plurality of notches 832 aligned with a lower end of each of the grooves 852 in the side skirts 850.

The electrically conductive spring contact 810 is formed to have contact beams 812 for engaging the side contacts of a mating connector. The contact beams 812 project upward in a common plane from a carrier strip 814 optionally with L-shaped ground bars 816 between each beam 812. A first leg of each of the ground bars 816 is attached to the carrier strip 814 in a plane substantially the same as the beams 812. A second leg of each of the ground bars 816 project at a right angle to the plane. A plurality of locking tabs 818 are attached to the carrier strip 814 and project away from each of the beams 812. A plurality of shelf tabs 820 are attached to the carrier strip 814 and project downward away from each of the ground bars 816. The shelf tabs 820 are curled in a direction away from the second legs of the ground bars 816.

The spring contact 810 is mounted in the housing 828 so that each of the beams 812 passes through a hole 829 in the housing 828 such that each of the beams 812 is in contact with an interior side of the front and rear side wall 844. The first legs of the ground bars 816 project at right angles from an exterior of the side walls 844. The shelf tabs 820 and locking tabs 818 are bent to grip flat sides of the ground strip 830.

The second plurality of pins 802 have first ends and second ends. The first ends of the second plurality of pins 802 are connected to the carrier strip 814 such that second ends 855 of the first plurality of pins 835 and the second ends of the second plurality of pins 802 are arranged in rows and columns to engage the contact regions 826.

The first ends 845 of the high density header 800 can connect to any connector having a plurality of terminals or contact elements with a plurality of first contacts arranged in rows and columns in a connector with at least one second contact for engaging the contact beams 812. The connector that is mateable with the header 800 can be a vertical receptacle or an angled or right angle receptacle. Preferably, the terminals of the receptacle that is mateable with the header 800 have socket shaped contacts for engaging the first ends 845 of the header 800.

The circuit assembly 822 can be any assembly that includes a plurality of conductors, leads, plated through holes or conductive paths, pads or areas 826. The circuit assembly 822 can be a printed wiring board or a printed circuit board, such as a backpanel, a mother board or a daughter board. The circuit assembly 822 can be a cable assembly. The circuit assembly 822 can be rigid or flexible. In one typical situation, the header 800 is for electrically and mechanically interconnecting a backpanel or mother board 822 and a mating receptacle which, in turn, is for electrically and mechanically connecting to a daughter board that is perpendicular to the mother board 822.

It will be recognized by those skilled in the art that the ground structure of the present invention can be modified to be used on any angled receptacle or header where the two contacts of the contact elements of the receptacle or header are at an angle other than 180 degrees from one another.

The parts referred to throughout this specification can be made from known materials used to make similar conventional parts. For instance, the insulative housings can be made of various plastics, such as polyetherimide resin or polyphenylene sulfide resin. The conductive walls, conductive bases, baffles and shields can be made of any nonmagnetic metal or metal alloy including zinc, aluminum, copper, brass or alloys thereof. The contact elements of the present invention can be made from any suitable metal used for electrical terminals, such as brass, phosphor bronze, beryllium copper and the like. The contact elements may be plated or coated with a conductive layer, such as tin, nickel, palladium, gold, silver or a suitable alloy.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An electrical connector for electrically and mechanically interconnecting a circuit assembly having a plurality of contact regions and a mating connector having first side walls, a plurality of first contacts arranged in rows and columns within the first side walls and at least one second side contact, the electrical connector comprising:

a first plurality of electrically conductive pins, each of the pins having a first end and a second end, the first ends for engaging the first contacts;

an insulative housing having a cavity open at a first end, enclosed by front and rear elongated side walls and two end walls together with a floor perforated with a plurality of through holes each engaging one of the pins, a side skirt extending downward from each front and rear side wall, with a plurality of grooves, each of the grooves extending parallel to the pins and separated by a rib in each side skirt;

an elongated ground strip mounted between the side skirts, the ground strip having a plurality of notches aligned with an end of each of the grooves in the side skirts;

an electrically conductive spring contact formed to have contact beams for engaging the at least one second contact and projecting upward in a common plane from a carrier strip, a plurality of locking tabs attached to the carrier strip and projecting away from each of the beams, a plurality of shelf tabs attached to the carrier strip between the locking tabs and extending in the same direction as the locking tabs;

the spring contact mounted in the housing so that each of the beams is in contact with an interior side of the front and rear side wall, and the shelf tabs and locking tabs bent to grip flat sides of the ground strip; and a second plurality of pins having first ends and second ends, the first ends of the second plurality of pins connected to the carrier strip such that second ends of the first plurality of pins and the second ends of the second plurality of pins are arranged in rows and columns to extend to the circuit assembly and engage the contact regions.

2. The electrical connector of claim 1, wherein the first ends of the second plurality of the pins connect with exterior sides of the shelf tabs and locking tabs.

* * * * *